United States Patent [19]

Gammon

[11] 4,340,423

[45] Jul. 20, 1982

[54] CHARGING OF ZINC-SMELTING BLAST FURNACES

[75] Inventor: Michael W. Gammon, Whitchurch, England

[73] Assignees: Metallurgical Processes Limited; I.S.C. Smelting Limited, both of Nassau, The Bahamas

[21] Appl. No.: 238,440

[22] Filed: Feb. 26, 1981

[30] Foreign Application Priority Data

Mar. 21, 1980 [GB] United Kingdom ..... 8009723

[51] Int. Cl.[3] ..... C22B 19/08

[52] U.S. Cl. ..... 75/87; 75/88; 266/44

[58] Field of Search ..... 266/184, 44; 75/86, 75/87, 88

[56] References Cited

U.S. PATENT DOCUMENTS 4,212,667 7/1980 Gammon et al. ..... 75/86

*Primary Examiner*—M. J. Andrews

*Attorney, Agent, or Firm*—Holman & Stern

[57] ABSTRACT

A method of charging a zinc-smelting blast furnace with alternate loads of coke and zinc oxide material from a hopper by means of a central bell/annular bell charging device, in which the annular bell is lowered by a predetermined fixed distance, wherein the time ratio of the time taken to discharge the hopper contents to the time taken for the annular bell to be lowered the predetermined fixed distance is less than unity, preferably between 0.67 and a value less than 1.

3 Claims, 1 Drawing Figure

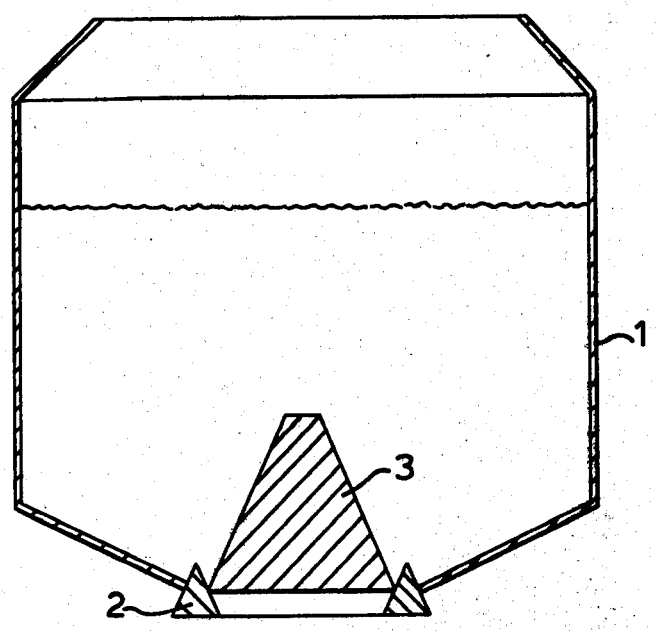
1
3
2

CHARGING OF ZINC-SMELTING BLAST FURNACES

BACKGROUND OF THE INVENTION

1. Field of the Invention

This invention relates to the charging of zinc-smelting blast furnaces with alternate loads of coke and zinc oxide material from a hopper by means of central bell-/annular bell charging gear.

2. Description of the Prior Art

In co-pending British Patent Application No. 45252/78 (published as Specification No. 2,009,903 on June 20, 1979) there is described and claimed a method of charging such a furnace whereby coke can be directed primarily toward the furnace centre or primarily toward the furnace walls as required, depending upon whether maximum fuel economy or wall-cleaning operation is required. This is achieved by lowering the annular bell through a predetermined fixed distance and either lowering the central bell through a smaller distance (for coke-rich wall charging) or keeping the central bell static or raising or lowering it through a smaller distance (for coke-rich centre charging). A similar procedure is adopted for charging zinc oxide material in the form of sinter or briquettes.

At the time of filing the above-defined patent application, it was not appreciated that another important parameter was the time taken to lower the annular bell through the predetermined fixed distance and more particularly the ratio of this time to the time taken for the hopper contents to completely discharge into the furnace.

It has now been realized that if the discharge time of the hopper contents is greater than the lowering time for the annular bell, then wall-directed charging of the hopper contents is impaired and that it is difficult to obtain consistent distribution of charge between the centre and the walls of the furnace.

SUMMARY OF THE INVENTION

The present invention aims to overcome this problem, and accordingly provides a method of charging a zinc-smelting blast furnace with alternate loads of coke and zinc oxide material from a hopper by means of a central bell/annular bell charging device, in which the annular bell is lowered by a predetermined fixed distance, wherein the time ratio of the time taken to discharge the hopper contents to the time taken for the annular bell to be lowered the predetermined fixed distance is less than unity. Preferably this time ratio is between 0.67 and a value less than 1.

The rate of lowering the annular bell is suitably within the range 40–100 mm/second, for hopper discharge times in the range 8 to 3 seconds, thus ensuring that the above-defined time ratio is appreciably less than 1.

Preferably the central bell is moved to its desired final position as quickly as is practicable following commencement of annular bell lowering.

Conventionally the annular bell is known in the art as the "ring bell" and the central bell is known as the "plug bell".

BRIEF DESCRIPTION OF THE DRAWING

The invention will be further described, by way of example only, with reference to the accompanying drawing, which is a diagrammatic sectional view through the bottom of a double-bell-and-hopper charging apparatus for use in carrying out the method of the present invention.

DESCRIPTION OF THE PREFERRED EMBODIMENTS

The drawing shows a charge hopper having side walls 1, an annular discharge 2 (ring bell), and a central discharge bell 3 (plug bell).

With a charge held within the walls 1 of the hopper and the bells 2 and 3 in their closed position (as shown), the upper hopper opening (not shown) is closed by means of a sealing bell and the furnace is ready for charging. For coke-rich centre charging of the furnace shaft, above which the charging apparatus is positioned, for the purpose of fuel economy, coke is placed in the hopper, the annular bell 2 is lowered by a predetermined distance (say 600 mm), and the central bell 3 is either kept static or raised or lowered by up to 300 mm, so that 25%–50% by weight of the coke contained in the hopper passes through the aperture in the annular bell.

For coke-rich charging of the walls of the furnace shaft for wall cleaning operations, coke is placed in the hopper, the annular bell 2 is lowered by the predetermined distance and the central bell 3 is lowered by a smaller distance (e.g. 150–300 mm), so that 5% to 20% by weight of the coke contained in the hopper passes through the aperture in the annular bell.

Thus in the first-mentioned situation more of the hopper contents flow to the centre of the furnace shaft than to the walls thereof, whereas in the second-mentioned situation more of the hopper contents flow to the walls of the shaft than to the centre thereof. Thus if the hopper contents are predominantly coke the first mode of operation leads to coke-rich centre charging of the furnace shaft and the second mode to coke-rich wall charging thereof. If the hopper contents are predominantly sinter then the first mode of operation leads to sinter-rich centre charging of the furnace shaft and the second mode to sinter-rich wall charging thereof.

In either case the time ratio of the time taken to discharge the hopper contents to the time taken for the annular bell to be lowered the predetermined fixed distance is arranged to be less than unity, in accordance with the present invention.

The invention will be further described with reference to the following illustrative example of a charging sequence for charging zinc oxide sinter into a zinc-smelting blast furnace.

SINTER CHARGING SEQUENCE

Ring bell falls by a total of 600 mm.

Plug bell falls by a total of 100 mm.

Sequence of events is as follows:

(1) Hopper filled with sinter.

(2) Ring bell opens at a speed of 100 mm/second to a final position of −600 mm, i.e. 6 seconds opening time.

(3) Half second after ring bell opens (i.e. when ring bell has lowered 50 mm) plug bell begins to move to its set position at a speed of 150 mm/second, to a final position of −100 mm, which is thus reached 1.17 seconds after the ring bell opens.

(4) Ring and plug bells remain in the their opened positions for several seconds before closing.

(5) Before closing, the plug bell is always moved to its +300 mm position in case any bridging of the charge in the hopper has occurred.

Thus the sequence of events, which is in respect of sinter-rich wall charging of the furnace, is as follows:

| Time (sec) | Ring Position (mm) | Plug Position (mm) | |
|---|---|---|---|
| 0 | 0 | 0 | None or little solids |
| 0.5 | −50 | 0 | discharged |
| 1.0 | −100 | −75 | |
| 1.50 | −150 | −100 | Solid discharged |
| 2.0 | −200 | −100 | through gap between ring and hopper, very little through centre of ring. |
| 3.0 | −300 | −100 | Charge flows through |
| 4.0 | −400 | −100 | both the centre and |
| 5.0 | −500 | −100 | outside of the ring bell |
| 6.0 | −600 | −100 | Hopper empty |
| 7–20 sec. approx. | −600 | −100 | |
| 20–30 sec. | Closing sequence of Ring and Plug bells with Plug bell moving to +300 before the 0 position to clear any obstruction. Hopper is now filled with coke and cycle is repeated. | | |

Time for sinter to completely discharge - approximately 5 seconds from time 0.

In this case the time ratio of the time taken to discharge the hopper contents to the time taken for the annular bell to be lowered the predetermined fixed distance is 5 seconds/6 seconds=0.83.

The following are typical figures for ring-and-plug charging for a zinc-smelting blast furnace.

| | | | |
|---|---|---|---|
| SPEED OF RING LOWERING = | 100mm/second | | |
| PREDETERMINED LOWERING DISTANCE FOR RING = | 600mm | | |
| SPEED OF PLUG RAISING OR LOWERING = | 150mm/second | | |
| LIMITS OF PLUG MOVEMENT | UP | (+) | 300mm |
| | DOWN | (−) | 300mm |

For coke-rich wall charging (as when melting accretions) and sinter-rich centre charging the plug settings are as follows:

| COKE | SINTER |
|---|---|
| −300 | +300 |

In this case 16% coke and 53% of sinter in the hopper are directed towards the centre of the furnace.

For zinc production (coke-rich centre charging and sinter-rich wall charging) the plug settings are as follows:

| COKE | SINTER |
|---|---|
| +50 | −150 |

In this case 43% of coke and 17% of sinter are directed towards the centre of the furnace.

There is also a standby situation where the plug settings are as follows:

| COKE | SINTER |
|---|---|
| −100 | 0 |

In this case 23% of coke and 38% of sinter are directed towards the furnace centre.

I claim:

1. In a method of charging a zinc-smelting blast furnace with alternate loads of coke and zinc oxide material from a hopper by means of a central bell/annular bell charging device, in which the annular bell is lowered by a predetermined fixed distance, the improvement comprising that the time ratio of the time taken to discharge the hopper contents to the time taken for the annular bell to be lowered the predetermined fixed distance is less than unity.

2. The method according to claim 1, wherein said time ratio is between 0.67 and a value less than 1.

3. The method according to claim 1, wherein the annular bell is lowered at a rate of 40–100 mm/second and wherein the hopper contents are discharged in a time of 8 to 3 seconds.

* * * * *